US008007619B2

(12) United States Patent
Bernabei et al.

(10) Patent No.: US 8,007,619 B2
(45) Date of Patent: Aug. 30, 2011

(54) CERAMIC SANITARY FIXTURE

(75) Inventors: Alessandro Bernabei, Imola (IT); Fabrizio Falletta, Imola (IT)

(73) Assignee: Sacmi Cooperativa Meccanici Imola Societa' Cooperativa, Imola (IT)

( * ) Notice: Subject to any disclaimer, the term of this patent is extended or adjusted under 35 U.S.C. 154(b) by 644 days.

(21) Appl. No.: 12/171,981

(22) Filed: Jul. 11, 2008

(65) Prior Publication Data

US 2009/0019630 A1 Jan. 22, 2009

(30) Foreign Application Priority Data

Jul. 20, 2007 (IT) ..... BO2007A0503

(51) Int. Cl.
*E03D 11/02* (2006.01)

(52) U.S. Cl. ..... 156/242; 4/420; 264/299

(58) Field of Classification Search ..... 156/242
See application file for complete search history.

(56) References Cited

U.S. PATENT DOCUMENTS

2005/0115042 A1* 6/2005 Davies et al. ..... 29/401.1
2007/0124913 A1 6/2007 Davies et al.

* cited by examiner

*Primary Examiner* — Philip Tucker
*Assistant Examiner* — Vicki Wu
(74) *Attorney, Agent, or Firm* — Pearne & Gordon LLP

(57) ABSTRACT

A ceramic sanitary fixture, in particular a ceramic toilet bowl (1) made by casting in resin or porous molds comprises: a first, bottom component (2) comprising a liquid collection pan (3) and a siphon portion (4) for draining out the liquids; a second, top component (5), or rim, composed of a front portion (6) forming the upper edge of the pan (3) and a rear extension (7) comprising a channel (8) for the passage of liquids; the first component (2) and the second component (5) of the bowl (1) are made in one piece in the mold to form a single part (2-5) and there is also a third, covering component (10), or outer casing, in which the single part (2-5) can be housed, the latter being able to be associated and assembled with the casing (10) at least at its upper edges.

9 Claims, 6 Drawing Sheets

FIG.12
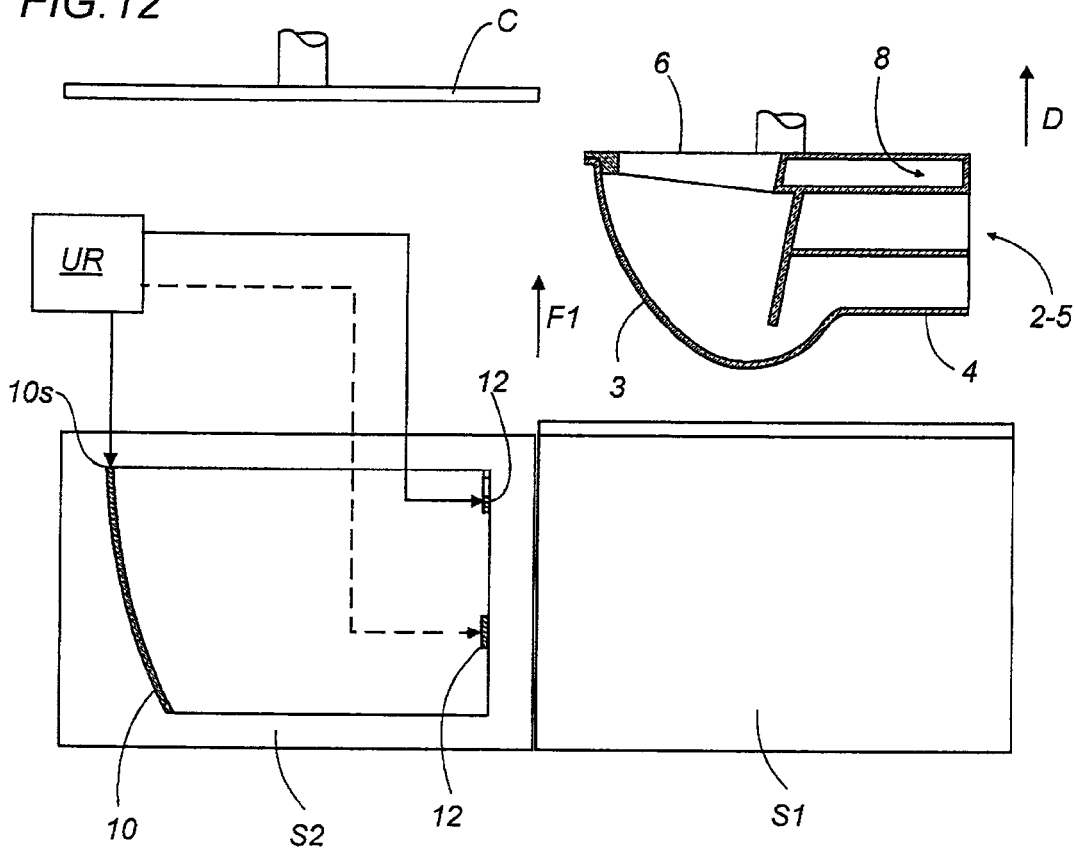
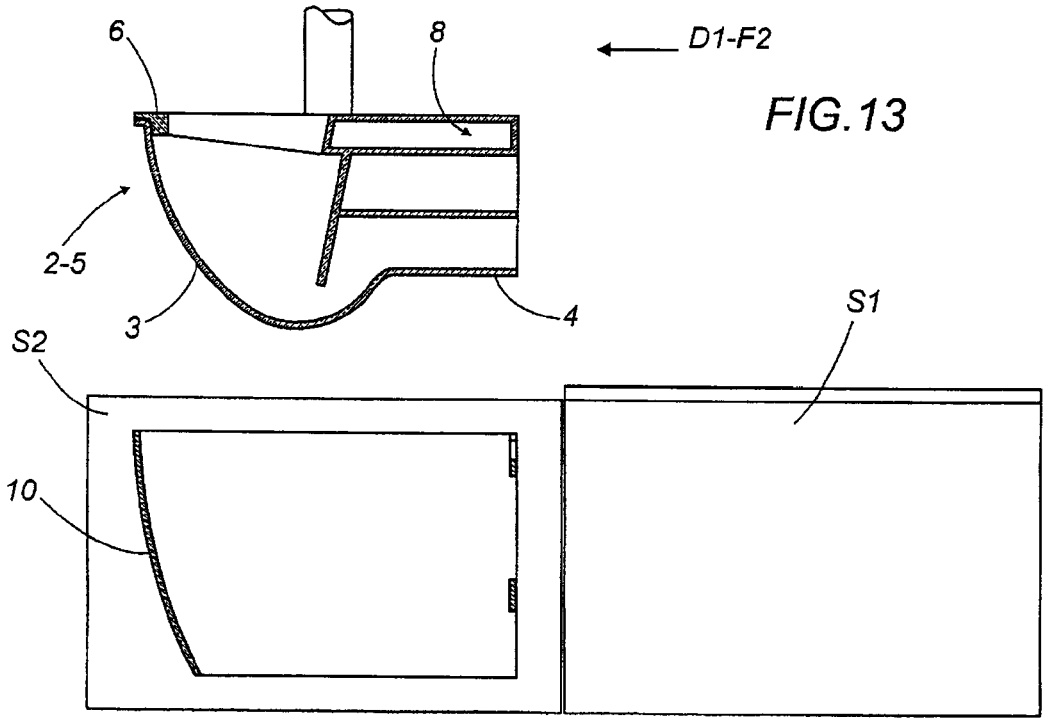
FIG.13

CERAMIC SANITARY FIXTURE

BACKGROUND OF THE INVENTION

This invention relates to a ceramic sanitary fixture, in particular a toilet bowl.

At present, a traditional ceramic sanitary fixture, that is to say, a toilet bowl formed by pressure casting a suspension known as "slip" in the jargon of the trade, comprises two parts associated with each other: a first bottom part comprising a pan and a drain siphon (that is, the inner parts of the bowl) and a second top part or "rim".

The first part, consisting of the pan and siphon assembly, is the functional part of the bowl and must have dimensional characteristics such as to allow the collection pan and flushing system of the bowl to work correctly.

The rim has a portion that is usually, but not necessarily, ellipsoidal in shape, forming the upper edge of the pan and a rear extension, parallel to the siphon and having a hole for the passage of the flushing water.

This part can be made in two ways known in the jargon of the trade as "open rim" and "closed rim".

In an open rim, the section of the ellipsoidal portion is in the shape of an upturned U with the bottom surface open to allow the passage of the flushing water.

In a closed rim, on the other hand, the section of the ellipsoidal portion has a closed toroidal shape, where the wall facing the pan has a plurality of holes made in it through which the flushing water can pass.

Usually, at least if production is based on high pressure slip casting, the rim (particularly in the case of a rim of the closed type) and the pan and siphon assembly are made separately and the two parts are then attached to each other by bonding the rim to the pan and siphon assembly.

This operation is done while the parts are in the "green" state, that is, while they still have a high water content, so that after being bonded together, the assembled parts can be finished (even using robot units) by smoothing their surfaces to give the finished bowl a good appearance.

In the current market, there is an ever increasing demand for toilet bowl designs where the pan and siphon assemblies are totally enclosed in casings that come in many different styles, shapes and sizes.

To be able to make bowls of this kind, the moulds must have very large and complex liquid casting areas, thus increasing costs and creating considerable technological complications.

As a matter of fact, moulds for liquid casting allow sanitary fixtures to be designed in a wide variety of forms with the maximum aesthetic freedom and with different dimensional ratios requiring high-volume casting cavities. The mould cavity is not simply divided into male and female parts (as are moulds used in solid casting) and, instead, the walls of the product are formed by a single surface within the mould.

In other words, therefore, the demand for different bowl styles reduces the level of standardization of the constructional components, necessitating not only different mould types but also different manufacturing processes, easily increasing the cost of the finished products.

SUMMARY OF THE INVENTION

To overcome the above mentioned disadvantages, the Applicant has therefore designed and produced a ceramic sanitary fixture, in particular a toilet bowl, structured in such a way as to allow a higher level of standardization for some of its components, combined with the possibility of obtaining a wide variety of toilet bowl styles while maintaining production times and costs at levels similar to those of traditional sanitaryware and creating sanitary fixtures with high functional reliability.

The technical purpose and aims stated above are substantially achieved by a ceramic sanitary fixture, in particular a toilet bowl, comprising the technical characteristics set out in one or more of the appended claims.

BRIEF DESCRIPTION OF THE DRAWINGS

The technical characteristics of the invention, with reference to the above aims, are clearly described in the appended claims and its advantages are apparent from the detailed description which follows, with reference to the accompanying drawings which illustrate a preferred embodiment of the invention provided merely by way of example without restricting the scope of the inventive concept, and in which:

FIGS. 10 to 14 illustrate different steps in the process for the production of the sanitary fixture according to the invention, FIG. 10 being a schematic perspective view while the others are schematic side views.

DESCRIPTION OF THE PREFERRED EMBODIMENTS

Figure 1:
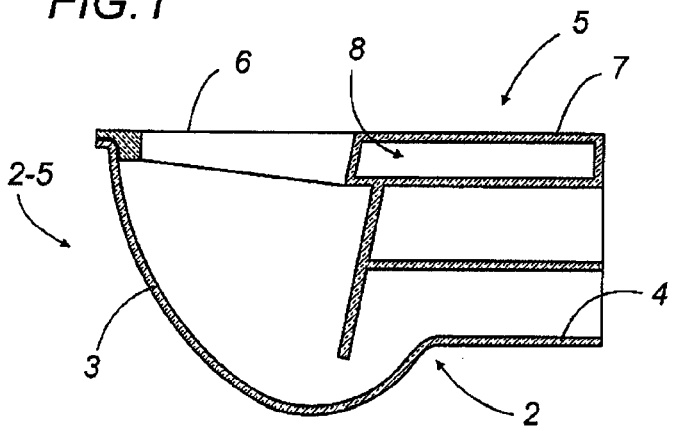
FIG. 1 is a schematic side section view of a first component of a ceramic sanitary fixture according to this invention, and in particular, a single item comprised of a rim and a pan and siphon.
Figure 2:
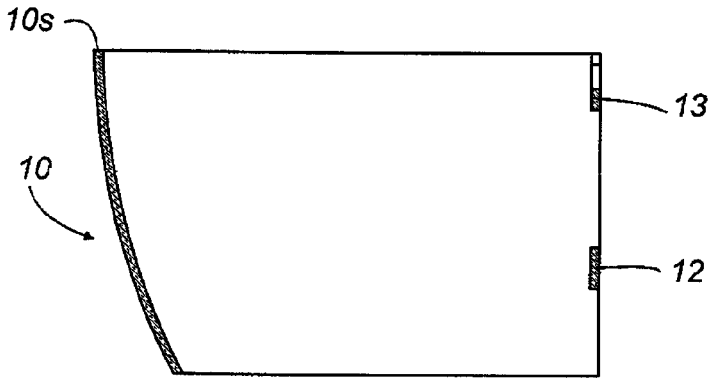
FIG. 2 is a schematic side section view of a second component of the ceramic sanitary fixture according to this invention, and in particular, a casing for housing the first component.
Figure 3:
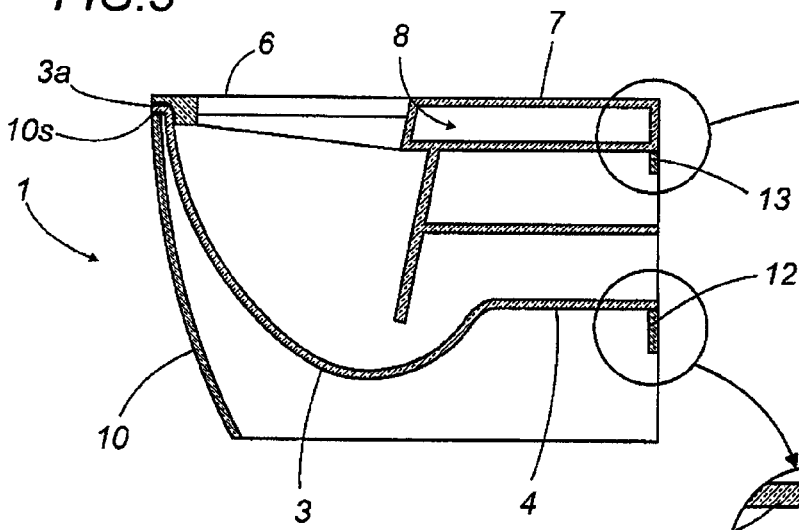
FIG. 3 is a schematic side section view of the ceramic sanitary fixture according to this invention in a configuration where the two components are assembled.

With reference to the accompanying drawings, in particular FIGS. 1 to 3, the sanitary fixture according to the invention is of the type made of ceramic material by casting a liquid (known as "slip") in porous resin moulds.

More specifically, this sanitary fixture consists of a ceramic toilet bowl 1 essentially comprising:

- a first, bottom component 2 comprising a liquid collection pan 3 and a siphon portion 4 for draining out the liquids;
- a second, top component 5, or rim, composed of a front portion 6 forming the upper edge of the pan 3 and a rear extension 7 comprising a channel 8 for the passage of the liquids.

As clearly shown in FIG. 3, the first and the second component 2 and 5 are made in one piece in the mould to form a single part 2-5 and there is also a third, covering component 10, or outer casing, in which the single part 2-5 can be housed, the latter being able to be assembled and associated with the casing 10 at least at its upper edges.

The casing 10 is also made of ceramic material by casting in a porous resin mould.

Figure 4:
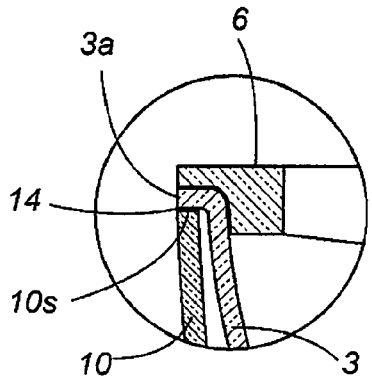
FIGS. 4, 5 and 6 are scaled-up details from FIG. 3.

Looking more closely at the details (with reference also to FIG. 4), at least the pan 3 has an undercut 3*a* interposed, after assembly, between the front portion 6 and an upper perimetric wall 10*s* of the casing 10 in such a way as to make visible the top of the rim 5 and the front surface of the undercut 3*a* of the pan 3.

Figure 4A:
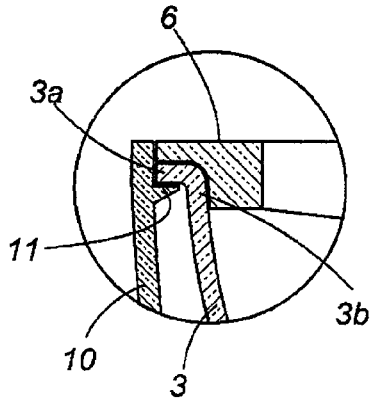
FIG. 4*a* illustrates an alternative embodiment of the detail of FIG. 4.

In an alternative embodiment illustrated in FIG. 4*a*, the surface of the pan 3 defining the undercut 3*a* extends at least along its adjacent portion 3*b* which is coupled to the respective front portion 6 of the rim 5.

The undercut 3*a* can be associated with a matching supporting protrusion 11 located on the front inside surface of the casing 10 so that, once assembled, only the top of the rim 5 remains visible.

Figure 6:
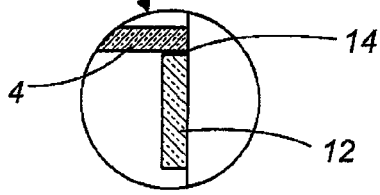
Figure 7:
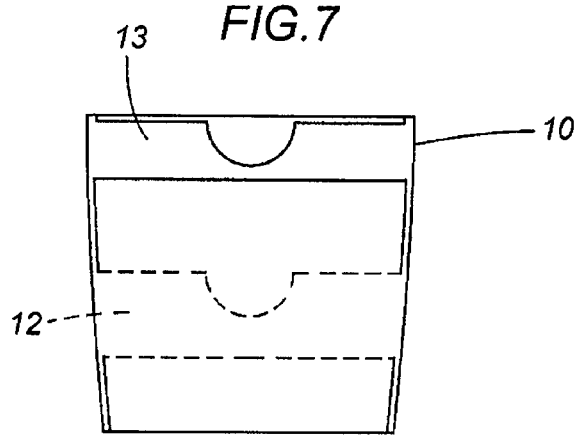
FIG. 7 is a schematic rear face view of the second component of FIG. 2.
Figure 8:
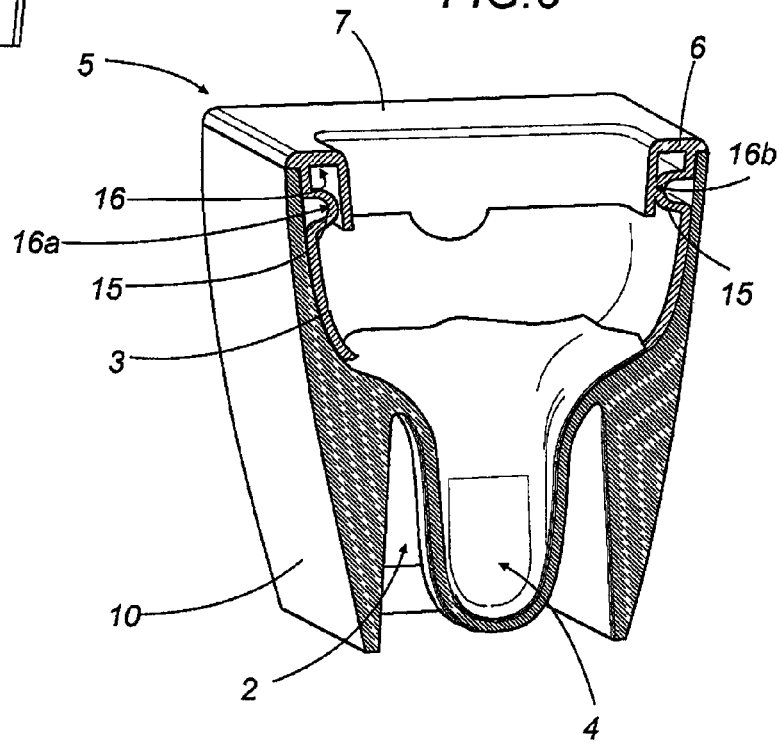
FIG. 8 is a front perspective view, partly in cross section, of a part of a mould for the first component of FIG. 1.

The casing 10 (see also FIG. 7, dashed line, and FIG. 8) may have a rear vertical surface that is partially open and shaped to form at least one first wall 12 (see also FIG. 6) in such a way as to provide a support for the end section of the siphon 4 upon assembly of the two parts 2-5 and 10.

Figure 5:
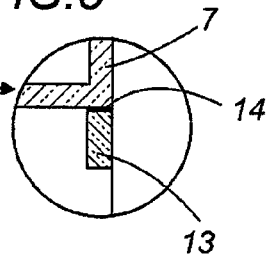

Alternatively (or in combination) the casing 10 has, again on the rear, partially open vertical surface, a second wall 13 (see also FIG. 5) in such a way as to provide a support for the end section of the rear portion 7 of the rim 5, again upon assembly of the two parts 2-5 and 10.

Obviously, the presence of one or the other of these two walls 12 and 13 will depend on the configuration of the single part 2-5, that is to say, on the type of rim 5 and siphon 4 to be obtained.

The vertical surface of the casing 10 constituting the first wall 12 and/or the second wall 13, extends in a horizontal direction, protruding partially towards the inside of the casing 10 to support the respective parts (as the case may be).

Between the single part 2-5 and the casing 10 bonding means 14 are provided for irreversibly joining the two parts 2-5 and 10 to each other.

These bonding means 14 (usually always slip with a higher percentage of water compared to that of the two parts when they are extracted from the moulds) are located between the undercut 3*a* of the pan 3 and the matching perimetric upper wall 10*s* of the casing 10.

In the embodiment illustrated in FIG. 4*a*, the bonding means 14 may be located between the undercut 3*a* of the pan 3 and the matching protrusion 11 of the casing 10.

Obviously, the bonding means 14 may be located between the first wall 12 and/or the second wall 13 of the casing 10 and, respectively, in the end section of the siphon 4 and/or the end section of the rear portion 7 of the rim 5 so as to enable the two parts 2-5 and 10 to be joined to each other correctly.

Figure 9:
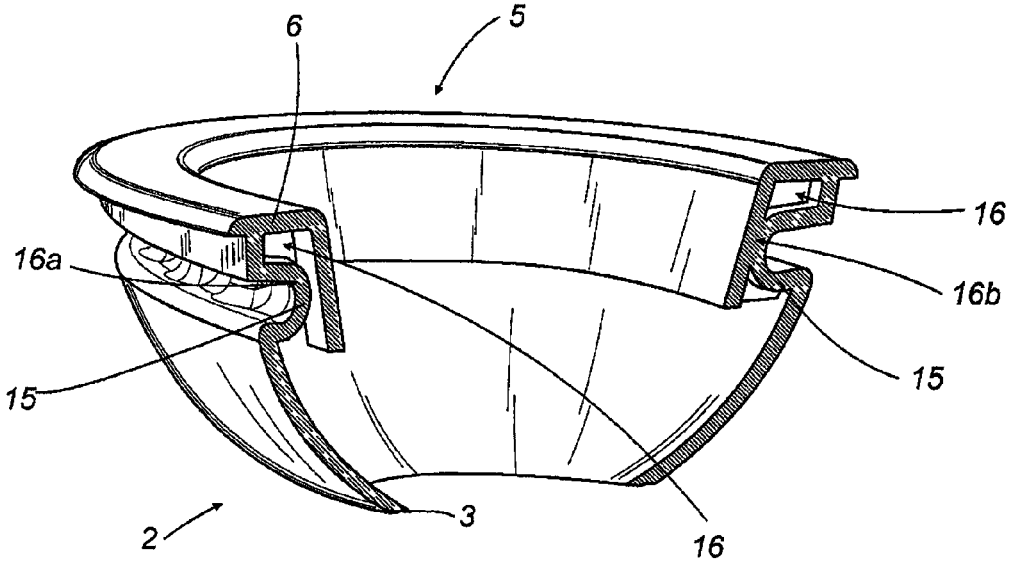
FIG. 9 shows a part of the first component, in particular the front portion of a rim, in a partially perspective view with some parts in cross section to better illustrate certain details.
Figure 9A:
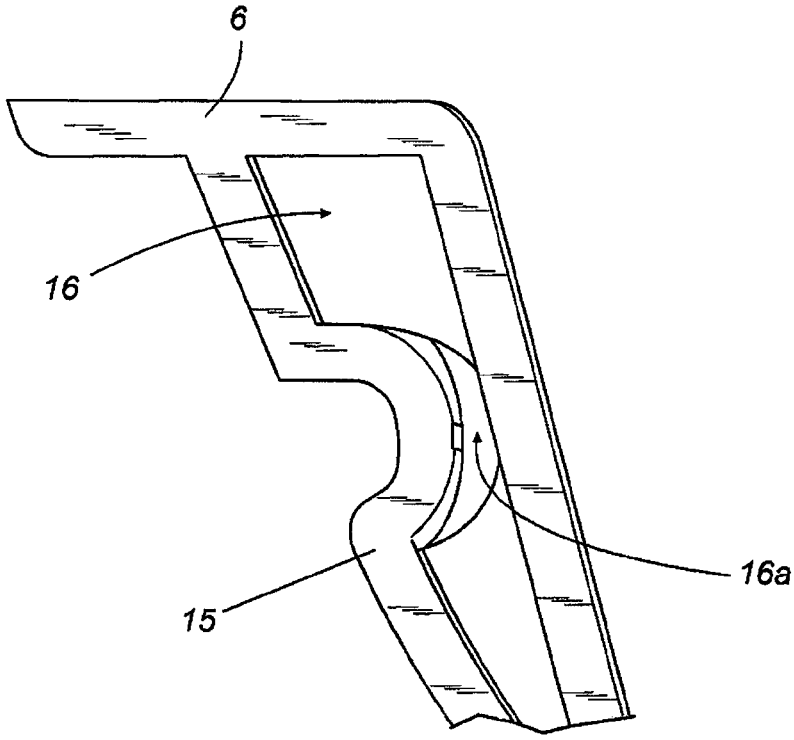
FIGS. 9*a* and 9*b* are schematic face views showing details of two different parts of the lateral profile of the first component of FIG. 9.
Figure 9B:
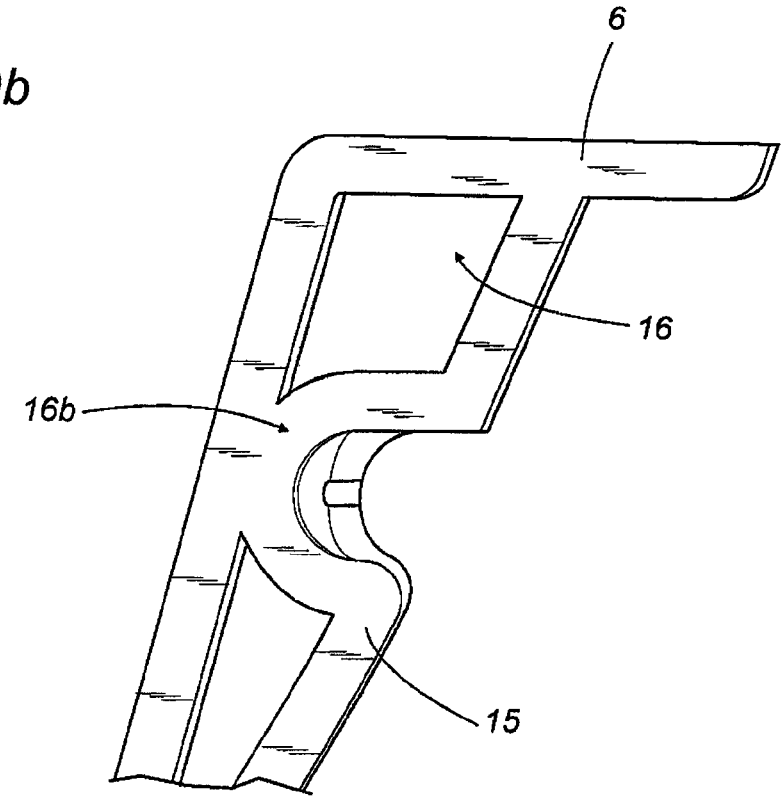

An example embodiment of the rim 5 is illustrated in FIGS. 9, 9*a* and 9*b*.

In this embodiment (by way of example only), the front portion 6 of the rim 5 has a substantially toroidal shape and is divided into two sections joined to each other to form: a continuous upper channel 16 for the passage of fluid, in use, and a surface 15 having a profile shaped like a C rotated towards the outside of the rim 5 and extending in undulated fashion along the entire front portion 6 in such a way as to form open sections 16*a* (see FIG. 9*a*) alternated with closed sections 16*b* (see FIG. 9*b*) along the whole of the toroidal portion 6: this shape enables liquid supplied through the channel 8 to flow along the channel 16 and to be drained alternately along the ellipsoidal portion 6 in a manner similar to that of a rim 5 of substantially closed type.

Figure 14:
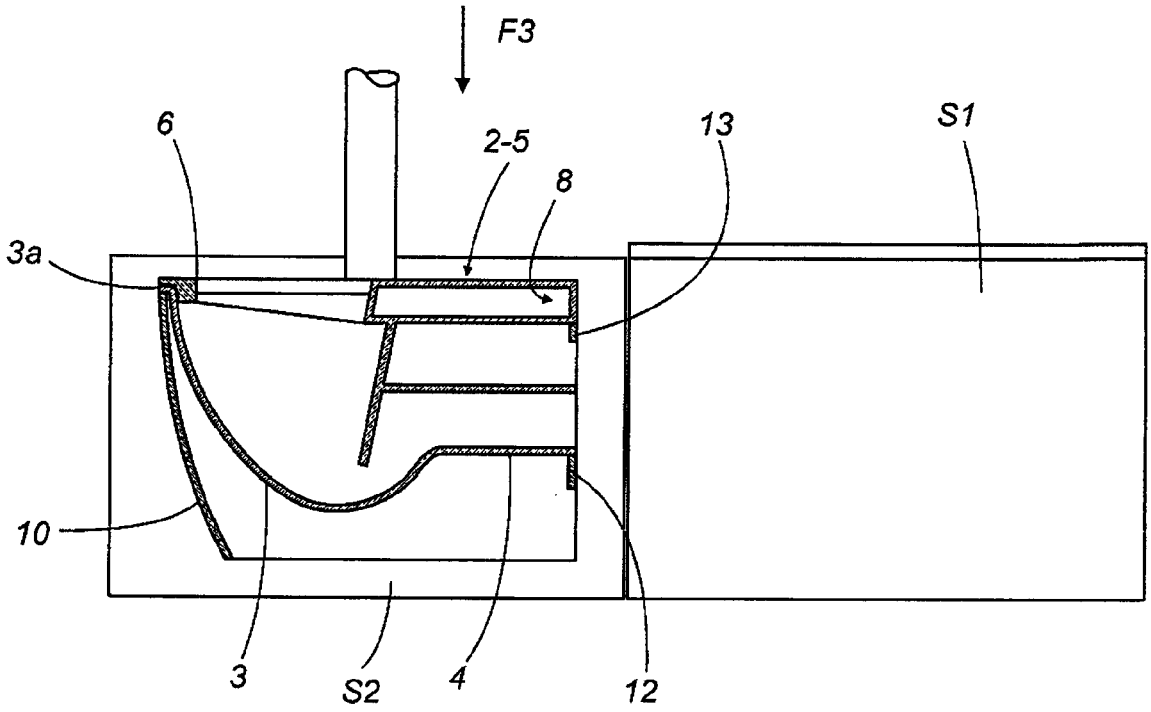

The sanitary fixture 1 described up to now can be obtained in the following steps:

- making, in a first mould portion S1 forming part of a single machine M for casting ceramic fixtures, the above mentioned components in a single part 2-5 defining the pan 3, the siphon portion 4, the front portion 6 forming the upper edge of the pan 3, and a rear extension 7 in which there is a channel 8 for the passage of the liquids (see FIGS. 10 and 11);
- simultaneously making the casing 10 in a second mould portion S2 forming part of the machine M (again see FIGS. 10 and 11);
- simultaneously moving the single part 2-5 away from the first mould portion S1 and the cover C of the second mould portion S2 (see FIG. 12, arrows F1);
- applying the bonding means 14 to the respective parts 11, 10*s*, 12 and/or 13 of the casing 10 (see FIG. 12);
- moving the single part 2-5 in such a way as to lift the single part 2-5 itself to a position above the casing 10 (FIG. 13, arrow F2);
- moving the single part 2-5 into contact with the casing 10 in such a way that the bonding means 14 join them together to form a permanent assembly (FIG. 14, arrow F3).

Figure 10:
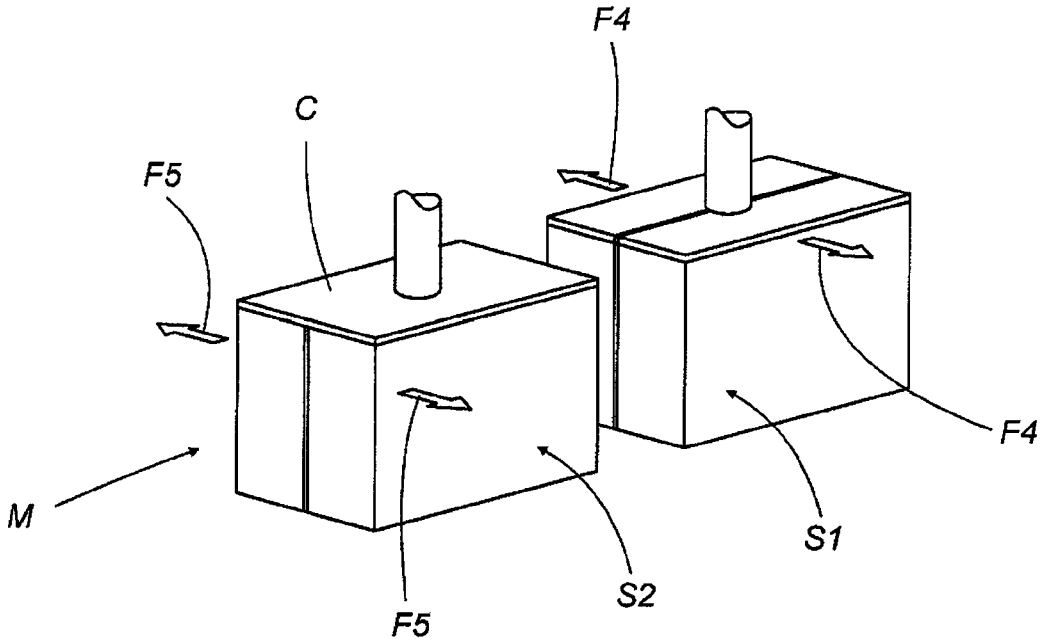
Figure 11:
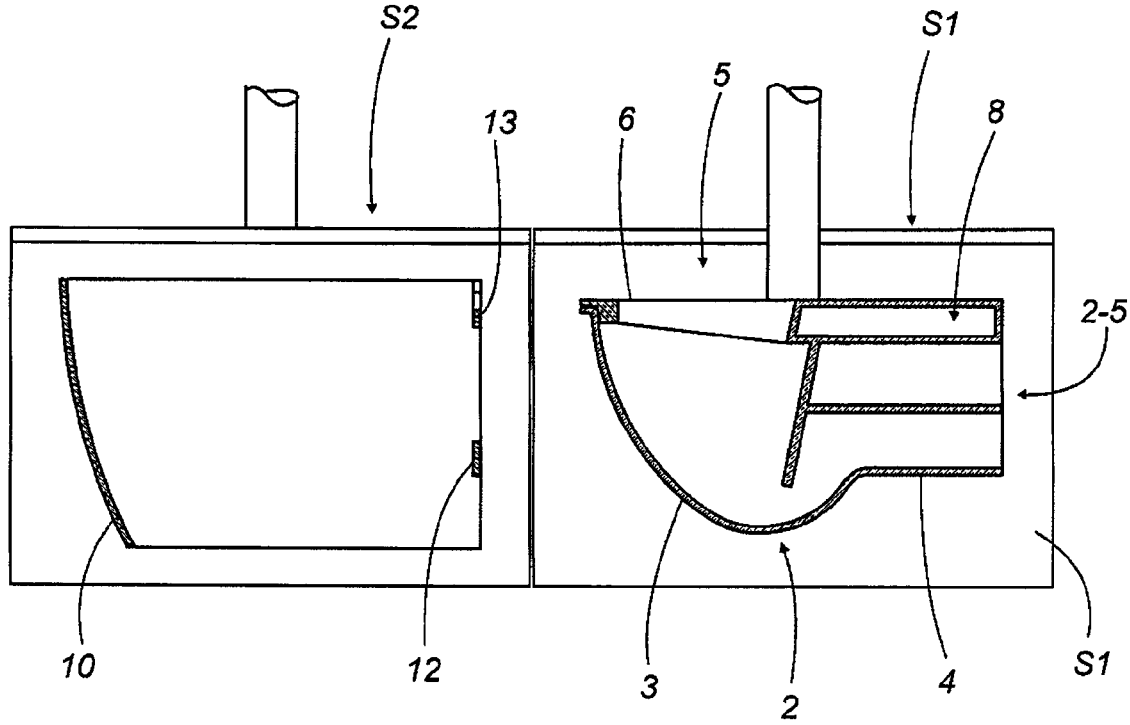

As indicated by the arrows F4 in FIG. 10, the step of lifting the single part 2-5 is preceded by at least one step of opening the sides of the first mould portion S1 also comprising two upper half-walls of the first mould portion S1 itself in order to release the single part 2-5.

The step of applying the bonding means 14 can be performed by a robot unit UR (schematically represented as a block FIG. 12).

This step can be performed in different sequences, depending on the program of the unit UR and/or on the type of sanitary fixture 1 and in any case comprises applying the bonding means to: the above mentioned supporting protrusion 11 on the front inside surface of the casing 10; the upper perimetric surface 10*s* of the casing 10 on which the undercut 3*a* of the pan 3 is rested; the first, rear wall 12 of the casing 10 supporting the end section of the siphon 4; the second rear wall 13 supporting the end section of the rear portion 7 of the rim 5.

In the embodiment illustrated, the first and the second mould portion S1 and S2 are positioned close to each other (in the schematic representation, the two portions are positioned one after the other by way of example only).

With this arrangement of the moulds S1 and S2, the above mentioned step of moving the single part 2-5 may be performed in a direction D1 at right angles to the direction D in which the first mould portion S1 is moved away.

Lastly, the step of joining and assembling the single part 2-5 to the casing 10 is followed by a step of opening the second mould portion S2 (see arrow F5, FIG. 10), that is to say moving the lateral portions of the second mould portion S2 apart, so as to allow further processing of the sanitary fixture 1 thus obtained.

A sanitary fixture 1 made in this way and the method for manufacturing it therefore achieve the above mentioned aims thanks to the possibility of making a single part (which may be standardized) comprising all the functional components of the fixture, while all the aesthetic characteristics of the fixture are embodied in the casing of the end product.

This allows a higher level of standardization to be achieved in the manufacture of certain basic fixture components, combined with the possibility of obtaining a wide variety of toilet bowl styles while maintaining production times and costs at levels similar to those of traditional sanitaryware and creating sanitary fixtures with high functional reliability.

The invention described above is susceptible of industrial application and may be modified and adapted in several ways without thereby departing from the scope of the inventive concept. Moreover, all the details of the invention may be substituted by technically equivalent elements.

What is claimed is:

1. A method for making a sanitary fixture (1), comprising at least the following steps:

making, in a first mould portion (S1) forming part of a single machine (M) for casting ceramic fixtures, a first and a second component (2-5) in a single part defining a pan (3), a siphon portion (4), a front portion (6) forming an upper edge of the pan (3), and a rear extension (7) in which a channel (8) for the passage of liquids is formed;

simultaneously making a casing (10) in a second mould portion (S2) forming part of the single machine (M);

simultaneously moving the single part (2-5) away from the first mould portion (S1) and a cover (C) of the second mould portion (S2);

applying a bonding means (14) to respective parts (11, 12, 13) of the casing (10);

moving the single part (2-5) in such a way as to lift the single part (2-5) to a position above the casing (10);

moving the single part (2-5) close to the casing (10) in such a way that the bonding means (14) join them together to form a permanent assembly.

2. The method according to claim 1, wherein the step of lifting the single part (2-5) is preceded by at least one step of opening the sides of the first mould portion (S1) also comprising two upper half-walls of the first mould portion (S1) itself.

3. The method according to claim 1, wherein the step of applying the bonding means (14) is performed by a robot unit (UR).

4. The method according to claim 1, wherein the bonding means (14) are applied to a supporting protrusion (11) made on the front inside surface of the casing (10).

5. The method according to claim 1, wherein the bonding means (14) are applied to an upper perimetric surface (10*s*) of the casing (10) supporting an undercut (3*a*) of the pan (3).

6. The method according to claim 1, wherein the bonding means (14) are applied to a first rear surface (12) of the casing (10) providing a support for the end section of the siphon (4).

7. The method according to claim 1, wherein the bonding means (14) are applied to a second rear surface (13) supporting the end section of the rear portion (7) of the rim (5).

8. The method according to claim 1, wherein the first and the second mould portion (S1, S2) are positioned close to each other and the step of moving the single part (2-5) is performed in a direction (D1) at right angles to the direction (D) in which the first mould portion (S1) is moved away.

9. The method according to claim 1, wherein the step of joining the single part (2-5) to the casing (10) is followed by a step of opening the second mould portion (S2) so as to allow further processing of the sanitary fixture (1) thus obtained.

* * * * *